US006272693B1

(12) United States Patent
Godoy

(10) Patent No.: US 6,272,693 B1
(45) Date of Patent: Aug. 14, 2001

(54) DIVE MASK WITH INCLINED GLASSES

(75) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 0 days.

(21) Appl. No.: 09/458,988

(22) Filed: Dec. 10, 1999

(30) Foreign Application Priority Data

Dec. 11, 1998 (IT) ..... FI98A0265

(51) Int. Cl.[7] ..... A61F 9/02
(52) U.S. Cl. ..... 2/430
(58) Field of Search ..... 2/430, 428, 429, 2/431, 432, 440; 351/43

(56) References Cited

U.S. PATENT DOCUMENTS 3,944,345 * 3/1976 Decorato ..... 351/43
5,345,615 * 9/1994 Garofalo ..... 2/430
5,420,649 * 5/1995 Lewis ..... 2/430 X
5,819,321 * 10/1998 Wang ..... 2/428

FOREIGN PATENT DOCUMENTS

GE91A0002 1/1991 (IT) .
01284748 8/1996 (IT) .

* cited by examiner

*Primary Examiner*—Peter Nerbun
(74) *Attorney, Agent, or Firm*—Browdy and Neimark

(57) ABSTRACT

A dive mask comprising a rigid frame (1) for supporting transparent glasses (3), and a flexible seal (5) extending from the contour of the frame (1) and fit to be secured on the diver's face by means of an adjustable strap. The glasses (3) are supported by the frame (1) so as to have a downward inclination with respect to the orthogonal plane of the visual axis (X) of the diver when the mask is put on. In the dive mask, the ratio between the height of the glasses (3), measured orthogonally to the axis of view (X) when the mask is put on, and the maximum distance between the axis of symmetry of the frame (1) and the edge of each glass (3) is greater than or equal to 0.75. The view of the upper chest portion of the diver is made possible.

20 Claims, 3 Drawing Sheets

DIVE MASK WITH INCLINED GLASSES

DESCRIPTION

1. Field of the Invention

The present invention relates to the field of diving equipment, and in particular to a dive mask model.

2. Description of the Prior Art

As it is known, a dive mask comprises a rigid frame supporting a pair of plane glasses. A flexible seal extends from the contour of the frame and is fit to be positioned onto the diver's face to make the space in front of the eyes watertight. More specifically, the seal is positioned over a forehead portion, at the temples, the cheekbones and below the diver's nose, without covering the mouth. Sometimes a single moulded glass, letting at least partially protrude the nose enclosure of the seal, is provided in place of the pair of glasses. The glasses (or the single glass) of the mask lie on a plane perpendicular to the front axis of the face, i.e. to the diver's visual axis.

The frame supporting the glasses is provided with a ledge onto which the glasses themselves abut with the interposition of the edge of the flexible seal in order to support it. Locking means of the glasses are further provided, usually formed by thin rings, moulded according to the frame contour and apt to engage therewith to lock the glasses against the above-mentioned ledge.

The above-described structure entails a certain frame thickness; therefore, although the glasses have suitable dimensions for allowing a wide visual angle, the frame constitutes a hindrance for the view. In particular, the lower portion of the visual field is the one most affected by the frame thickness. In fact, even leaning forward the head as much as possible, until touching the chest, the frame screens altogether the view of the upper portion of the diver chest.

This entails no significant inconvenience in skin-diving. However, in case of a diving carried out with the complex apparatus required by the use of bottles, some important components thereof, in particular the control instruments located just at the upper chest portion, are left out of the diver's field of view. Hence, unless tiring and awkward twisting is performed, such instruments have to be laboriously operated by groping only.

A first solution of this problem, tested in the past yet readily discarded, foresees the mere downward inclination of the glasses. This did not achieve the desired effect, in view of the fact that, at the high angles required to provide the diver's chest sight, a considerable distortion of the perceived images occurs.

As a further solution, a dive mask provided with ancillary glasses inclined with respect to the main ones and located at the lower portion of the mask, and possibly also at both sides thereof, was proposed. This solution, disclosed in Italian patent application GE/91/A/000002, increases the diver's angle of view, but exhibits several drawbacks.

Firstly, the mask is bulkier and more expensive, and its design is subject to additional constraints, unavoidably making it unappealing. However, the most serious drawback lies in the fact that the ancillary glasses, which are substantially orthogonal to the main glasses, "fragment" the overall image perception, due to the presence of intermediate blind parts, corresponding to the angles between the main and the ancillary glasses. The resulting visual effect is extremely irksome, in light of the further magnification of the aforementioned blind parts due to the water refraction. In particular, due to the impermanency of the visualised item, the diver experiments queasiness and confusion.

Likewise solutions having analogous drawbacks, for instance the one disclosed in Italian patent No. 1284748, foresee the adoption of glasses having an at least partially curved development, therefore capable of increasing the angle of view below the mask and possibly at the sides thereof. In this instance as well, the problems of the image distortion and of the consequent discomfort to the diver are extremely relevant.

Surprisingly, by re-examining and thoroughly studying the most banal solution, i.e. that of the mere downward inclination of the glass, it has been found a novel structure of an inclined glass dive mask combining simplicity of design and attainment of an optimum chest visibility by the diver with no sensible image distortion.

SUMMARY OF THE INVENTION

Therefore it is an object of the present invention to provide a dive mask having a rigid frame for supporting at least one transparent glass, a flexible seal extending from the frame contour and apt to be secured on the diver's face by means of an adjustable strap. The at least one glass is supported by the frame so as to have a downward inclination with respect to the plane orthogonal to the diver's visual axis when the mask is put on, thereby facilitating the view of the upper chest portion of the diver. According to the invention, the ratio between the height of the at least one glass, measured orthogonally to the visual axis of view when the mask is put on, and the maximum distance between the axis of symmetry of the frame and the edge of the at least one glass is higher than or equal to 0.75.

Thus, the angle of view can remarkably be increased at the bottom side of the visual field, allowing the diver a chest view, although with a reduced angle of the glass plane of the mask, entailing no sensible distortion. The concept is explained in the annexed FIG. 1, schematically showing the variation of the visual angle as a function of the downward inclination of the plane of the mask glasses. It has to be noted that the planes defined below are represented by their respective traces on the plane of FIG. 1.

In the above figure, the diver's eye position is indicated at O and the front axis or visual axis of view thereof is indicated with X. A known vertical glass mask, the section plane of which is indicated by $A_oB$, allows a visual angle $\beta_o$ defined by a plane b, passing through point O as well as point B, corresponding to the top edge of the glasses, and by a plane $a_o$, passing through point O and a point $A_o$, belonging to the bottom edge of the same glasses.

Starting from this solution, in order to avoid the screening action of the bottom edge of the mask frame, it is necessary to downwardly incline the glass plane at an angle $\alpha_1$ by rotation around the top edge thereof, represented by point B, to displace the bottom edge of the glasses from $A_0$ to $A_1$. The point $A_1$ indicates the maximum allowable setback, corresponding to a positioning of such bottom edge at the diver's cheekbones. Thus, the angle of view is increased from $\beta_0$ to $\beta_1$, the latter angle being defined by the plane b and by a plane $a_1$, passing through points O and $A_1$. However, with the prior art mask geometry the angle $\beta_1$ entails an unacceptable image distortion, and this is the reason why it was found unsatisfactory, as explained in the introductory part of the description.

According to the invention, if the glasses have a longer relative height with respect to the known masks, the plane at the glasses can be inclined of an angle of $\alpha_2$, represented by the trace between B and $A_2$, which is sensibly less than $\alpha_1$, and therefore does not entail a considerable distortion, but yields an angle of view $\beta_2$ even greater than $\beta_1$ and defined by the plane $a_2$ passing through points O and $A_2$. This is possible because, as it is evident in the figure, point $A_2$ lies below point $A_1$, and therefore below the level of the diver's cheekbone. Hence the bottom edge of the frame does not hinder a suitable chest view.

BRIEF DESCRIPTION OF THE DRAWINGS

Characteristics and advantages of the dive mask having inclined glasses according to the present invention will be more fully understood hereinafter as a result of the description of an embodiment thereof, given by way of example and not for limitative purposes, with reference to the annexed drawings, wherein.

DESCRIPTION OF THE PREFERRED EMBODIMENT

Figure 2:
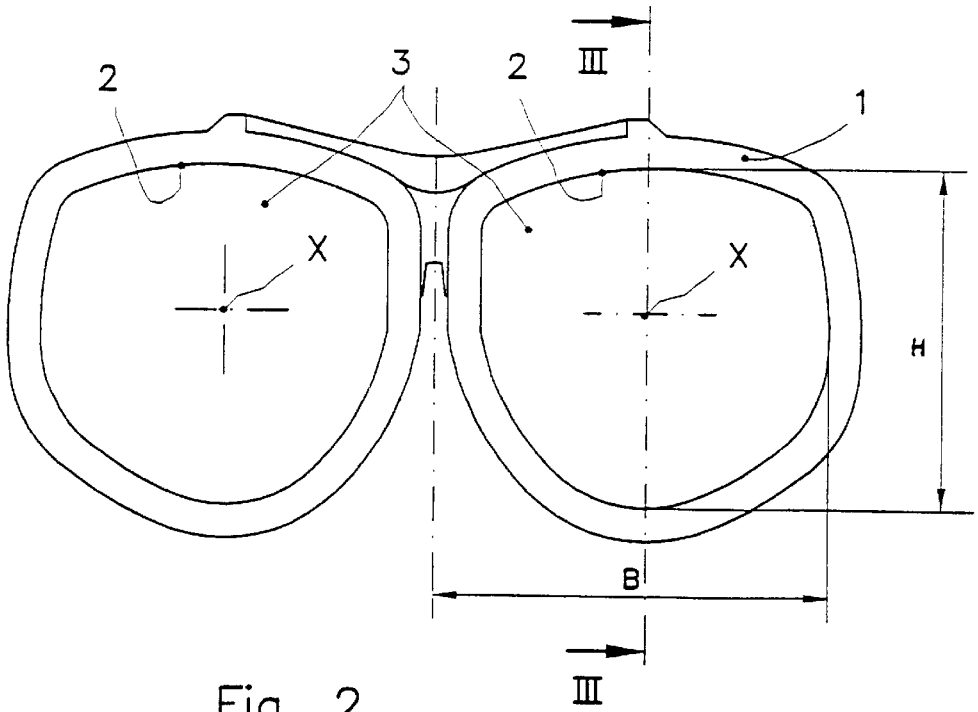
FIG. 2 is a schematic front view of a two-glass mask according to the invention.
Figure 3:
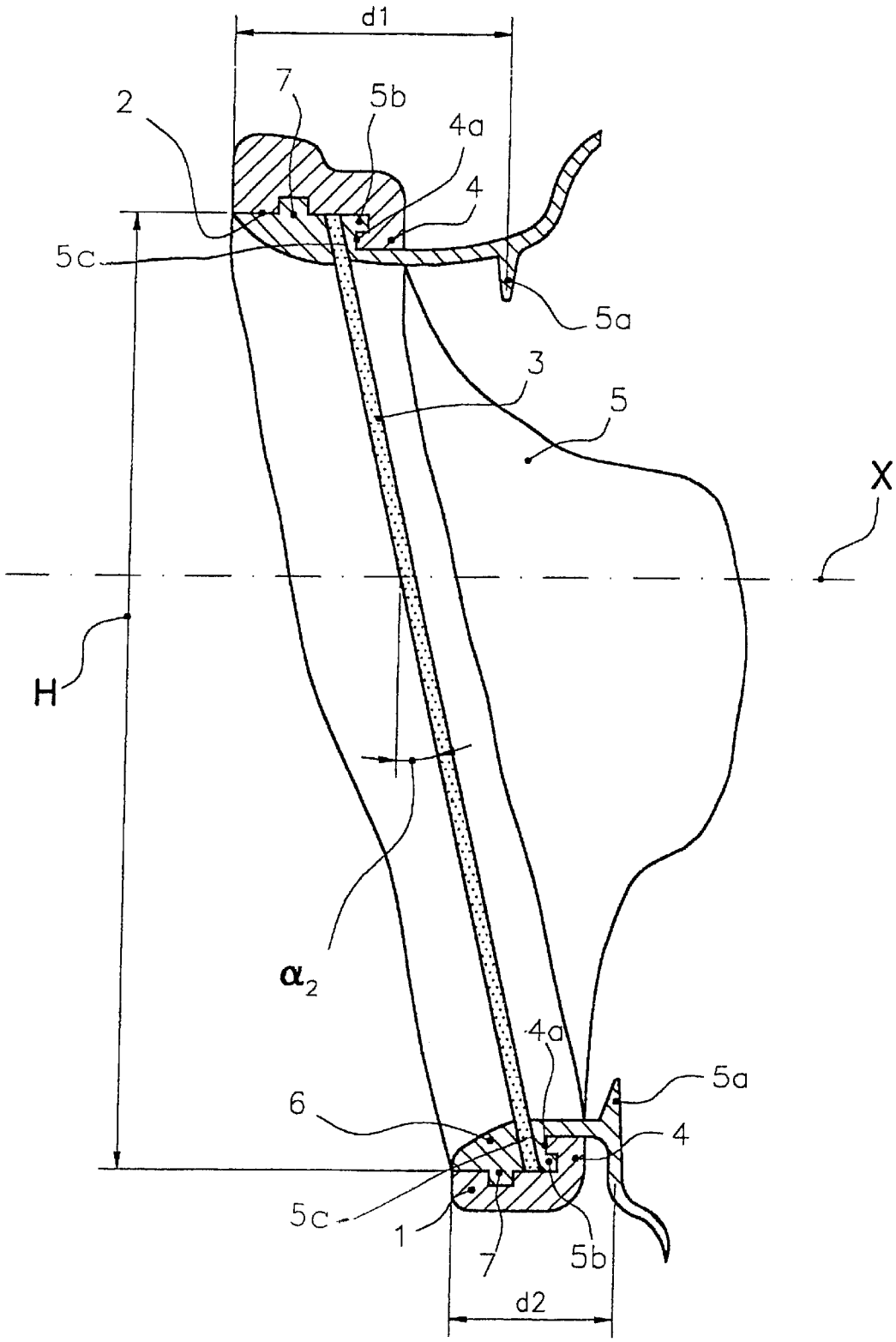
FIG. 3 is a section taken along line III—III of the mask in FIG. 2.

With reference to FIGS. 2 and 3, the mask according to the invention comprises a frame 1 of a substantially flat development, onto which two substantially cylindrical openings 2 for housing the respective glasses 3 are formed. From the frame 1 a elastic seal 5 extends, provided in the known way of a seal lip 5*a*, fit to be secured in a known manner onto the diver's face by means of an adjustable strap 8, connected to frame 1.

Seal 5 has an extension from frame 1 tapering from the top to the bottom side, thus, when the mask is put on, frame 1 assumes an overall configuration non-orthogonal to the visual axis X, unlike the known masks. More particularly, the connection between seal 5 and frame 1 is performed as shown in FIG. 3. Openings 2 are formed in such a manner that, when the mask is put on, the generatrices of their cylindrical surface be substantially parallel to the visual axis X.

Glasses 3 abut onto respective annular ribs 4, extending from frame 1 into openings 2, a folded edge 5*b* of seal 5 being interposed therebetween. More specifically each folded edge 5*b* defines an abutment surface 5*c* inclined at an angle $\alpha_2$ (see FIG. 3) with respect to a line either perpendicular to the generatrix of the respective cylindrical surface of opening 2 or to the visual axis x.

Respective locking rings 6, engaging with grooves 7 circumferentially formed in the openings 2, secure glasses 3 pressed onto ribs 4.

Therefore, the overall mask thickness, consisting of the extension of seal 5 and the thickness of frame 1, is considerably higher at the top (d1) rather than at the bottom side (d2). On the other side, the angle $\alpha_2$ of glasses 3 also results from the inclination of abutment surface 4*a* defined by ribs 4. In the solution shown in FIG. 3 the reduced thickness value at the bottom side of the mask is provided by the tapering thickness of the mask starting from the top side, as well as by the minimal extension of seal 5 there at.

In the mask according to the invention, in particular with reference to FIG. 2, the ratio between the height H of each glass 3 (and therefore of each opening 2), i.e. the distance between the top and bottom edges there of, measured orthogonally to the visual axis X of the diver wearing the mask, and the half-width value B (see FIG. 2) of frame 1, measured perpendicular from the vertical axis of symmetry thereof, is equal to or greater than 0.75. Advantageously, in the illustrated embodiment such ratio, hereinafter simply indicated as the relative height of the glasses, is approximately equal to 0.85. As a result, seal 5 is positioned in a known way onto the diver's forehead at the top side of frame 1, whereas it closes onto the facial region just below the cheekbones of the diver in the area below openings 2 with glasses 3.

Figure 4:
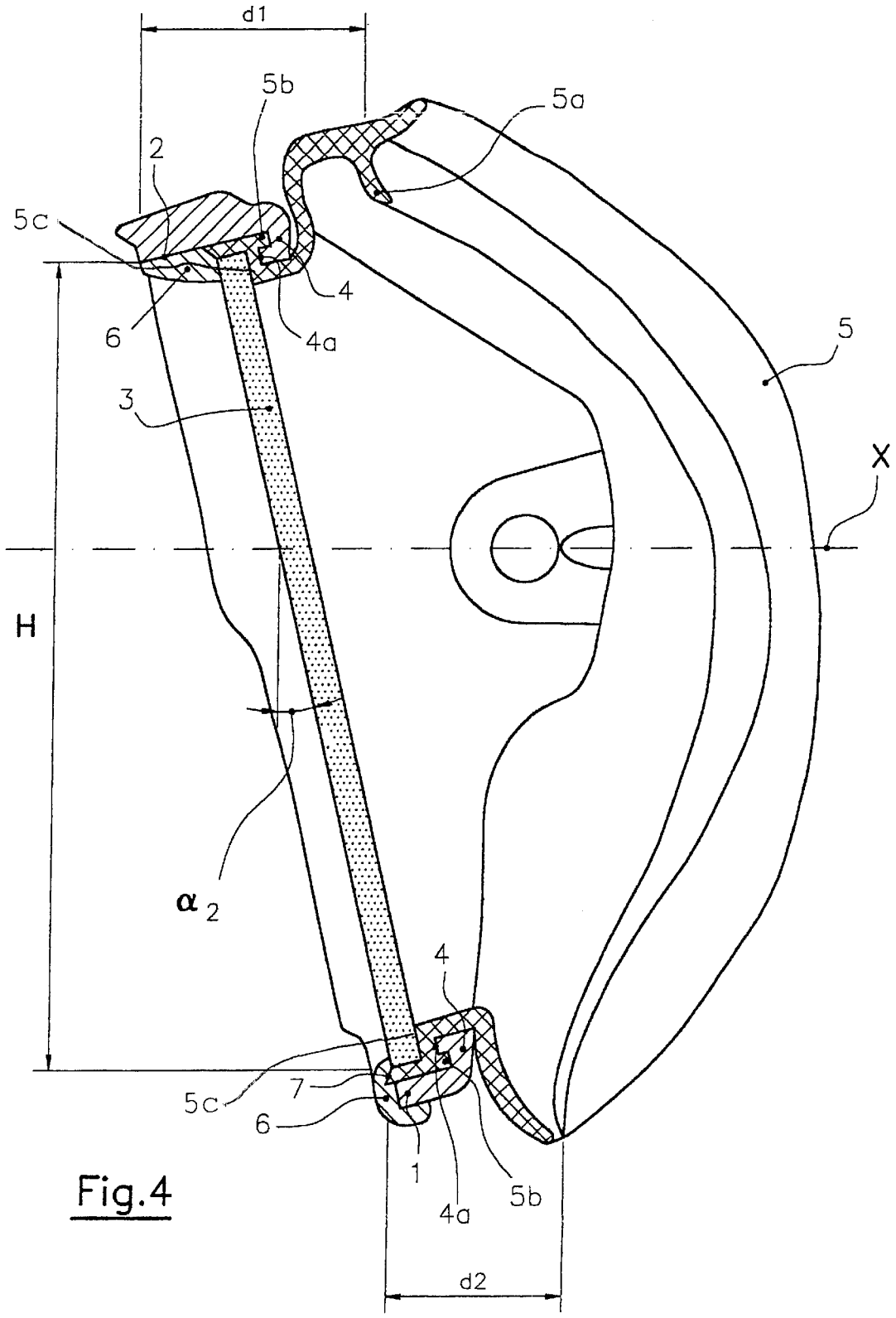
FIG. 4 is a section corresponding to that of FIG. 3 of an alternative embodiment of the mask according to the invention.

FIG. 4 shows, in sectional view, another embodiment of the invention which differs from that shown in FIG. 3 in the fact that the generatrices of the cylindrical surfaces delimiting openings 2 for housing respective glasses 3 are inclined downwardly with respect to the visual axis X as defined above. The same items in FIG. 3 and FIG. 4 are indicated with the same reference numbers.

Figure 1:
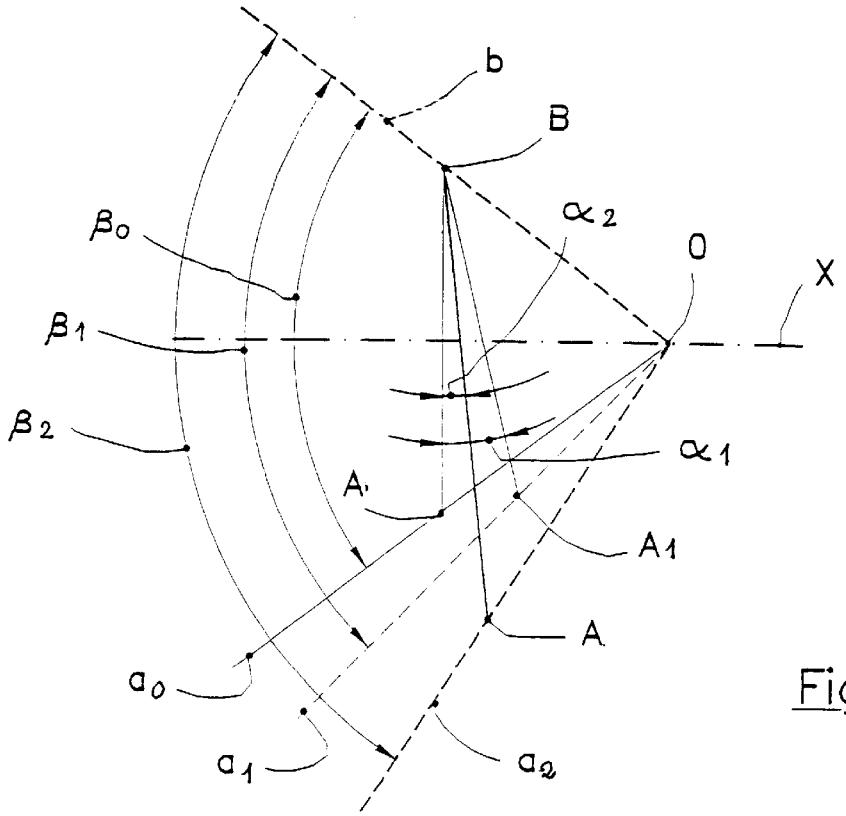
FIG. 1 is a diagram showing the modification of the diver's visual angle with the inclination of the mask glass plane in configurations according to the known art and in another according to the invention.

Therefore, with the mask according to the invention, and in accordance to what was here to disclosed referring to FIG. 1, even for a modest value of the inclination angle $\alpha_2$ of the plane of the glasses 3 with respect to the top edge thereof or a line perpendicular to visual axis x a considerable widening of the diver's angle of view is obtained, allowing an optimum chest visibility.

A value of the relative height of the glasses equal to or greater than 0.75 allows to limit the value of angle $\alpha_2$ to values preferably comprised between 12° and 15°. It has to be considered that values from 8° to 18° are quite acceptable, with no considerable inconveniences to the diver.

The dive mask according to the invention solves the visibility problem, and therefore the problem of the ease of operation of the control instruments carried by the diver at chest level during a diving performed with bottles, by means of a simple and suitable structure. In fact, the dive mask stands out for its stability, thanks to the reduced overall thickness on the bottom side thereof that minimises any possible flexure.

Further, it is of a particularly easy wear since it allows an almost uniform pressure distribution of seal 5 onto the diver's face.

Obviously, the above remarks also apply to masks provided with a single glass 3. In this case the relative height of the glass will equal the ratio between the height thereof, measured orthogonally to the visual axis when the mask is put on, and one half of its overall width.

Finally, it has to be pointed out that the terms top and bottom, and other analogous ones here to utilised, refer to the dive mask as worn by the diver standing on the ground, i.e. in the configuration shown in FIGS. 2 and 3.

Variations and/or modifications may be brought to the dive mask with inclined glasses according to the present invention, without departing from the scope of the invention itself as defined in the appended claims.

What is claimed is:

1. A dive mask adapted to engage a face of a user over a height from a forehead to below cheekbones of the user so that a visual axis (x) and angle of view ($B_2$) of the user are unobstructed by the dive mask, the dive mask comprising;

a rigid frame for supporting at least one and not more than two of a transparent glass;

a flexible seal extending from a contour of said frame adapted to be pressed against the face of the user by an adjustable strap;

a top portion of the frame and the seal adapted to engage the forehead of the user having a first width (d1);

a bottom portion of the frame and the seal adapted to engage below the cheekbones of the user having a second width (d2);

said first width (d1) being greater than said second width (d2);

said at least one glass being supported in said frame by an edge of the seal to incline downwardly at an angle (a2) to the visual axis (x) of the user when the mask is engaged on the face of the user;

a height (H) of said at least one glass measured perpendicular to the visual axis (x) of the user being substantially equal to the height from the forehead to below the cheekbones of the user;

wherein the angle of inclination (a2), the height (H) of the at least one glass and said first and second width (d1, d2) interrelate such that the angle of view (B2) of the user is unobstructed by the bottom portion of the frame and the seal.

2. The dive mask according to claim 1, wherein a ratio between the height (H) of said at least one glass and a maximum distance measured perpendicular to and between an axis of symmetry of said frame and a lateral outer edge of said at least one glass is equal or greater than 0.75.

3. The dive mask according to claim 2, wherein said ratio is approximately equal to 0.85.

4. The dive mask according to claim 1, wherein said downward inclination of said at least one glass is comprised between 8° and 18°.

5. The dive mask according to claim 4, wherein said inclination is comprised between 12° and 15°.

6. The dive mask according to claim 1, wherein said seal has an extension from said frame tapering from the top to the bottom side of the frame, so that, when the mask is put on, the frame assumes an overall configuration that is non-orthogonal to said visual axis.

7. The dive mask according to claim 1, wherein said at least one glass is housed in a corresponding opening formed in said frame, a respective annular rib extending into said opening from said frame and defining an abutment plane for said at least one glass which is included with respect to the perpendicular of said visual axis, to allow said downward inclination of said at least one glass.

8. The dive mask according to claim 7, wherein said opening is delimited by a substantially cylindrical surface such that, when the mask is put on, x the generatrix of said surface is parallel to said visual axis.

9. The dive mask according to claim 7, wherein said opening is delimited by a substantially cylindrical surface such that, when the mask is put on, the generatrix of said surface is inclined downwardly with respect to said visual axis.

10. The dive mask according to claim 1, wherein said frame has a thickness tapering from the top to the bottom side thereof.

11. The dive mask according to claim 3, wherein said at least one glass is housed in a corresponding opening formed in said frame, a respective annualar rib extending into said opening from said frame and defining an abutment plane for said at least one glass which is inclined with respect to the perpendicular of said visual axis, to allow said downward inclination of said at least one glass.

12. The dive mask according to claim 11, wherein said opening is delimited by a substantially cylindrical surface such that, when the mask is put on, the generatrix of said surface is parallel to said visual axis.

13. The dive mask according to claim 4, wherein said at least one glass is housed in a corresponding opening formed in said frame, a respective annular rib extending into said opening from said frame and defining an abutment plane for said at least one glass which is inclined with respect to the perpendicular of said visual axis, to allow said downward inclination of said at least one glass.

14. The dive mask according to claim 13, wherein said opening is delimited by a substantially cylindrical surface such that, when the mask is put on, the generatrix of said surface is parallel to said visual axis.

15. The dive mask according to claim 5, wherein said at least one glass is housed in a corresponding opening formed in said frame, a respective annular rib extending into said opening from said frame and defining an abutment plane for said at least one glass which is inclined with respect to the perpendicular of said visual axis, to allow said downward inclination of said at least one glass.

16. The dive mask according to claim 15, wherein said opening is delimited by a substantially cylindrical surface such that, when the mask is put on, the generatrix of said surface is parallel to said visual axis.

17. The dive mask according to claim 6, wherein said at least one glass is housed in a corresponding opening formed in said frame, a respective annualar rib extending into said opening from said frame and defining an abutment plane for said at least one glass which is inclined with respect to the perpendicular of said visual axis, to allow said downward inclination of said at least one glass.

18. The dive mask according to claim 17, wherein said opening is delimited by a substantially cylindrical surface such that, when the mask is put on, the generatrix of said surface is parallel to said visual axis.

19. The dive mask according to claim 1, having two of said transparent glass which are coplanar on both sides of the axis of symmetry of said frame.

20. A dive mask adapted to engage a face of a user over a height from a forehead to below cheekbones of the user so that a visual axis (x) and angle of view ($B_2$) of the user are unobstructed by the dive mask, the dive mask comprising;

a rigid frame for supporting at least one and not more than two of a transparent glass;

a flexible seal extending from a contour of said frame adapted to be pressed against the face of the user by an adjustable strap;

a top portion of the frame and the seal adapted to engage the forehead of the user having a first width (d1);

a bottom portion of the frame and the seal adapted to engage below the cheekbones of the user having a second width (d2);

said first width (d1) being greater than said second width (d2);

said at least one glass being supported in said frame by an edge of the seal to incline downwardly at an angle (a2) to the visual axis (x) of the user when the mask is engaged on the face of the user;

a height (H) of said at least one glass measured perpendicular to the visual axis (x) of the user being substantially equal to the height from the forehead to below the cheekbones of the user;

wherein the angle of view (B2) of the user is unobstructed by the bottom portion of the frame and the seal; and wherein a ratio between the height (H) of said at least one glass and a maximum distance measured perpendicular to and between an axis of symmetry of said frame and a lateral outer edge of said at least one glass is equal or greater than 0.75.

* * * * *